US008910694B2

(12) United States Patent
Kandakai

(10) Patent No.: US 8,910,694 B2
(45) Date of Patent: Dec. 16, 2014

(54) PORTABLE MODESTY GUARD

(76) Inventor: Tina L. Kandakai, Solon, OH (US)

( * ) Notice: Subject to any disclaimer, the term of this patent is extended or adjusted under 35 U.S.C. 154(b) by 0 days.

(21) Appl. No.: 13/615,560

(22) Filed: Sep. 13, 2012

(65) Prior Publication Data

US 2013/0240155 A1 Sep. 19, 2013

Related U.S. Application Data

(63) Continuation-in-part of application No. 13/420,605, filed on Mar. 14, 2012, now abandoned.

(60) Provisional application No. 61/452,162, filed on Mar. 14, 2011.

(51) Int. Cl.
*E04F 10/10* (2006.01)

(52) U.S. Cl.
USPC ..... 160/35; 160/36; 160/220; 160/352

(58) Field of Classification Search
USPC ..... 160/36, 35, 34, 32, 31, 220, 195; 211/105.3
See application file for complete search history.

(56) References Cited

U.S. PATENT DOCUMENTS

| | | | | |
|---|---|---|---|---|
| 1,655,515 | A * | 1/1928 | Simpson | 160/19 |
| 1,966,728 | A * | 7/1934 | Lecluyse | 160/220 |
| 2,465,853 | A * | 3/1949 | Dalton, Jr. | 4/558 |
| 2,967,567 | A * | 1/1961 | Heckerman | 160/62 |
| 3,249,233 | A * | 5/1966 | Marcus et al. | 211/105.3 |
| 4,594,742 | A | 6/1986 | Zeigler et al. | |
| 4,667,353 | A | 5/1987 | Zeigler et al. | |
| 5,402,999 | A * | 4/1995 | Keehn, Sr. | 473/472 |
| 5,868,191 | A * | 2/1999 | Blackmon, Jr. | 160/31 |
| 5,937,929 | A * | 8/1999 | Chen | 160/370.23 |
| 6,276,430 | B1 * | 8/2001 | Wu et al. | 160/265 |
| 6,364,389 | B1 | 4/2002 | Beigel | |
| 6,942,002 | B1 * | 9/2005 | Williams | 160/265 |
| 7,217,061 | B2 * | 5/2007 | Stratton | 404/6 |
| 8,365,798 | B2 * | 2/2013 | Feldpausch et al. | 160/84.06 |
| 2006/0053711 | A1 * | 3/2006 | Vaughan | 52/236.9 |
| 2011/0180222 | A1 | 7/2011 | Huang | |
| 2012/0234503 | A1 * | 9/2012 | Kandakai | 160/84.04 |

* cited by examiner

*Primary Examiner* — Blair M. Johnson
(74) *Attorney, Agent, or Firm* — Mathews Law Firm LLC

(57) ABSTRACT

The present invention generally relates to a portable modesty guard apparatus. More specifically, the present invention relates to a portable modesty guard for creating a private space in a public, or other, area. The portable modesty guard provides a unique construction which allows the user to collapse, store and carry the device in a way that allows it to be set-up quickly and packed away in a lightweight, portable unit.

22 Claims, 10 Drawing Sheets

PORTABLE MODESTY GUARD

RELATED APPLICATION DATA

This continuation-in-part patent application claims priority to U.S. Utility patent application Ser. No. 13/420,605 filed Mar. 14, 2012 which claims priority to U.S. Provisional Patent Application No. 61/452,162 filed Mar. 14, 2011, and titled "Portable Modesty Guard." The full text of this application is hereby incorporated by reference as though fully set forth herein in its entirety.

FIELD OF THE INVENTION

The present invention generally relates to a portable modesty guard apparatus. More specifically, the present invention relates to a portable modesty guard for creating a private space in a public, or other, area.

BACKGROUND OF THE INVENTION

The use of public spaces for private matters, such as for example, changing clothes in a locker room or nursing an infant, is often done with apprehension or reluctance. As a result, use of public facilities is either avoided completely or some alternative approach is used to obtain privacy and personal dignity. Although some public spaces by design have some elements of privacy built in via public restroom stalls, changing rooms, and shower stalls, these elements are often lacking in quantity, transferability, and accessibility.

SUMMARY

In one embodiment, the portable modesty guard comprises a casing, an end panel, a top extendable support member, a bottom extendable support member, and a shield positioned between the top and bottom extendable support members and secured thereto.

In another embodiment a portable modesty guard comprises a casing, an end panel, a first extendable support member and a second extendable support member attached to the casing and to the end panel, wherein the first and second extendable support members are extendable away from the casing. The portable modesty guard further includes a shield that extends between the first and second extendable support members. The casing comprises an inner casing portion and an outer casing portion which are movable relative to one another between a nested position and an extended position.

The portable modesty guard creates privacy and dignity during the use of public spaces.

DESCRIPTION OF THE DRAWINGS

The various embodiments of the present invention can be understood by the following drawings and figures. The components are not necessarily to scale.

DETAILED DESCRIPTION OF THE INVENTION

The present invention provides various embodiments of a portable modesty guard which allows the user to be shielded from open exposure while in public settings. The modesty guard is designed to be compact, easy to use, and to provide privacy to individuals who are uncomfortable being exposed in public settings.

Figure 2:
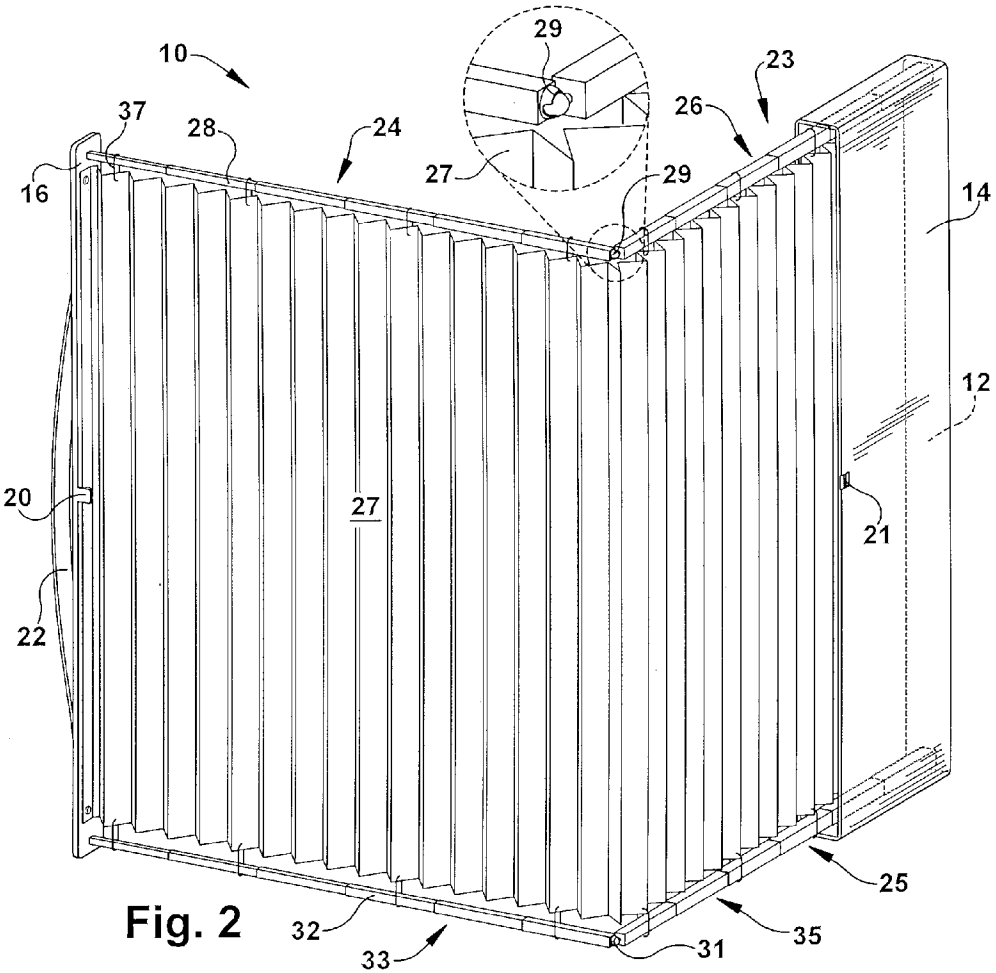
FIG. 2 is a perspective view of the portable modesty guard of FIG. 1 in an open position, according to an embodiment of the present invention.
Figure 1:
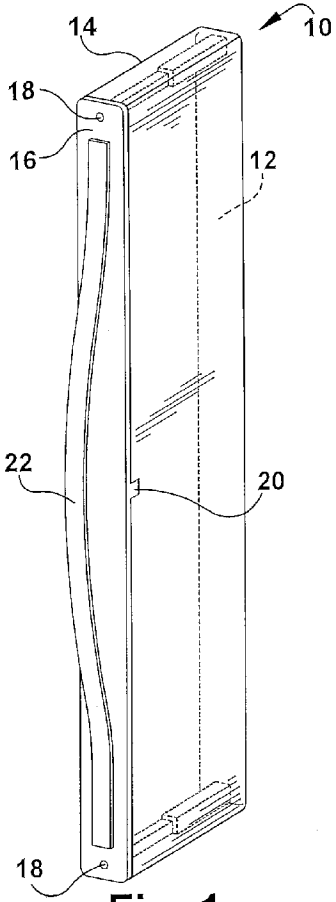
FIG. 1 is a perspective view of a portable modesty guard in a closed position, according to an embodiment of the present invention.

Turning to FIGS. 1 and 2, FIG. 1 is a perspective view of the portable modesty guard of the present invention in a closed position. As illustrated in FIGS. 1 and 2, the portable modesty guard 10 comprises a casing 14 with a base 12 (shown in phantom), an end panel 16, a top extendable support member 23, a bottom extendable support member 25, and a screen or shield 27. As can be seen in FIG. 1, top extendable support member 23 and bottom extendable support member 25 are attached to end panel 16 via any suitable attachment device 18. Such suitable attachment devices include, but are not limited to, rivets, bolts, screws, nails, pins, clips, adhesive bonds, metal welds, ultrasonic welds, etc.

In another embodiment, the top and bottom extendable support members 23 and 25 each can independently further comprise at least one joint, hinge or other suitable type of bending or flexing unit or mechanism 29 and 31, respectively, to permit the portable modesty guard to extend in at least two different directions or planes. Therefore, in an example embodiment the top extendable support member 23 is divided into a first portion 24 and a second portion 26 separated by flexing unit 29, and the bottom extendable support member 25 is divided into a first portion 33 and a second portion 35 and separated by flexing unit 31.

In still another embodiment, the top and bottom extendable support members 23 and 25 are formed from a plurality of telescoping units that slide inward or outward in overlapping sections. FIGS. 1 and 2 show that the lengths of telescoping units of the first portion 24 and the second portion 26 of the top extendable support member 23 fit into casing 14, as do the lengths of the telescoping units of the first portion 33 and the second portion 35 of the bottom extendable support member 25. Regarding the plurality telescoping units, single member 28 and 32 are illustrated in FIG. 2, with 28 being a top single unit and 32 being a bottom single unit. The plurality of telescoping units that in this embodiment form the top and bottom extendable support members can be any suitable shape. Such suitable shapes include, but are not limited to, round, oval elliptical, square, rectangular, polygonal, etc.

In one embodiment, screen or shield 27 can be attached, secured or otherwise connected to top and bottom extendable support members 23 via any suitable connection device 37. Such suitable connection devices include, but are not limited to, at least one retention clip, at least one hanger designed to either hang the screen or shield 27 from the top extendable support member 23 or fit into a slot formed in the bottom surface of the top extendable support member 23. In another embodiment, screen or shield 27 is attached, secured or otherwise connected to top extendable support member 23 by a loop formed in the material from which screen or shield 27 is itself made of (see shield or screen 27 of FIG. 6).

In any of the embodiments described above, portable modesty guard 10 can further include at least one handle 22 on the exterior surface of end panel 16. Handle 22 can be used to carry the portable modesty guard 10 and can also be used to aid user in opening the unit by pulling the handle 22 to separate end panel 16 from casing 14. Portable modesty guard 10 can further include a closure device, for example a latch comprising lever 20 and catch 21, to ensure positive closure when the portable unit is not in use.

Figure 3:
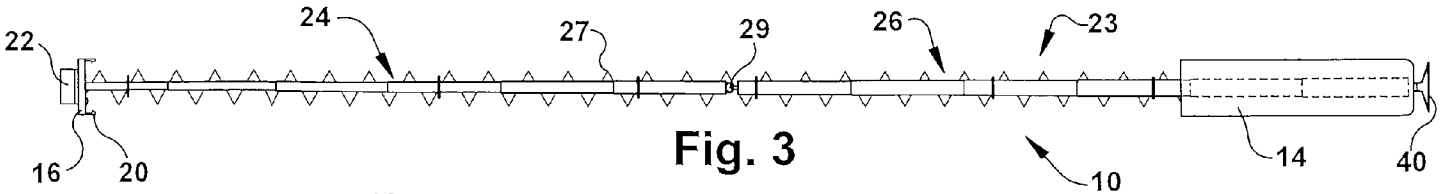
FIG. 3 is a top view of the portable modesty guard in an open position and wherein the first extendable support member and second extendable support member are extended along a single plane, according to an embodiment of the present invention.
Figure 4:
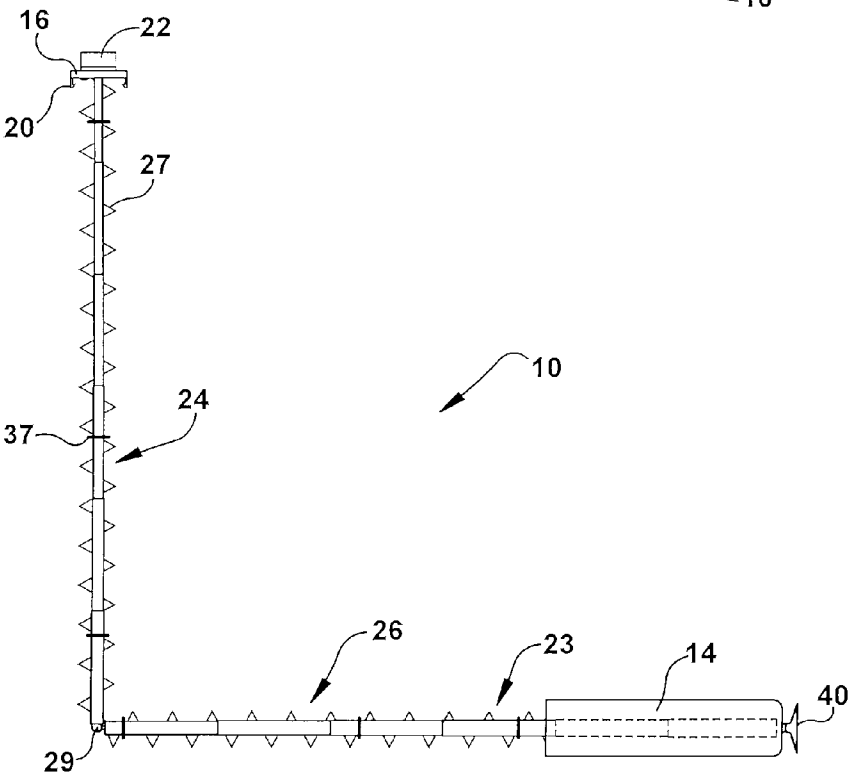
FIG. 4 is a top view of the portable modesty guard in an open position and the first extendable support member and second extendable support member are extended and disposed in two planes, according to an embodiment of the present invention.

Turning to FIGS. 3 and 4, FIG. 3 is a top illustration of portable modesty guard 10 illustrating portable modesty guard 10 in an extended position where the guard extends in a single plane. On the other hand FIG. 4 illustrates portable modesty guard 10 in an extended position where the portable modesty guard extends in two different planes. As would be apparent, the present invention is not limited to either of these embodiments. Rather, portable modesty guard 10 could be designed and/or configured to permit screen or shield 10 to be extended in two or more different planes, for example with the use of two or more flexing units.

Regarding the individual components of portable modesty guard 10 described above, for example casing 14, end panel 16, top and bottom extendable support members 23, 25, shield 27, etc., can independently be made from any suitable material. Suitable materials include, but are not limited to, metal, metal alloys, plastic or polymeric materials, paper, etc. Regarding screen or shield 27, screen or shield 27 can be formed from any suitable material. Such suitable materials include, but are not limited to, paper, plastic sheeting, polymeric materials, fabric, cloth, polymer coated cloth or fabric, or any combination thereof. In another example embodiment, screen or shield 27 can be corrugated, pleated, or pre-folded as shown in FIGS. 2, 3 and 4. Alternatively, screen or shield 27 may drape as smooth or drape naturally to permit for easy storage.

Figure 5:
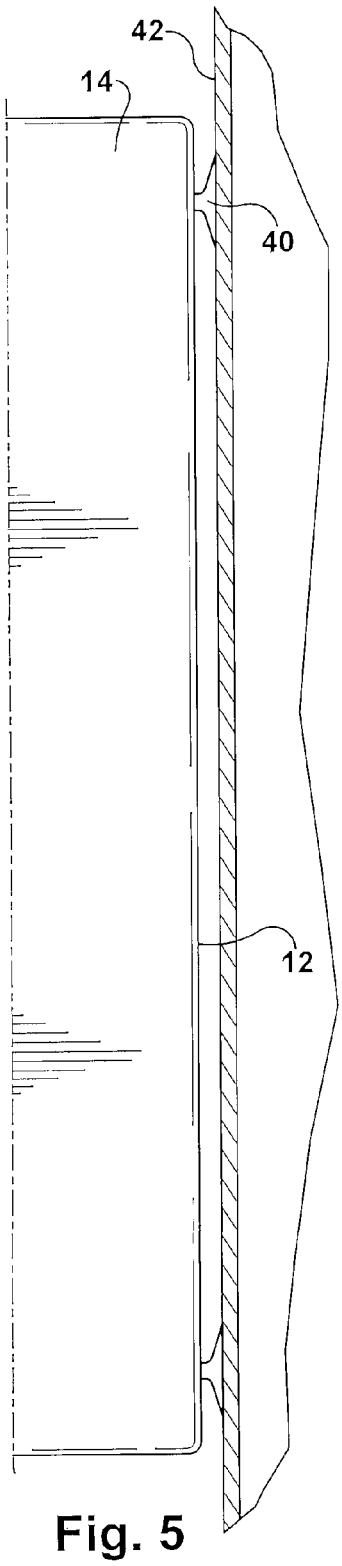
FIG. 5 is a schematic view of the casing of the portable modesty guard mounted to a surface, according to an embodiment of the present invention.

Referring to FIG. 5, FIG. 5 illustrates portable modesty guard 10 attached or mounted to a surface 42 via at least one mounting member 44, for example suction device 40. Surface 42 can be any desired surface to which portable modesty guard 10 is to be affixed, adhered, attached, etc. Such surfaces include, but are not limited to, wood, Formica, metal, plastic, tile, wallboard, etc. As would be apparent, more than one suction device 40 can be utilized to affix or "hand" portable modesty guard 10 to surface 42. Suction device 40 can be selected from any suitable device that permits one object to be attached to another object via a low grade vacuum. Suitable suction devices include, but are not limited to, suction cups, or other suction devices.

Figure 6:
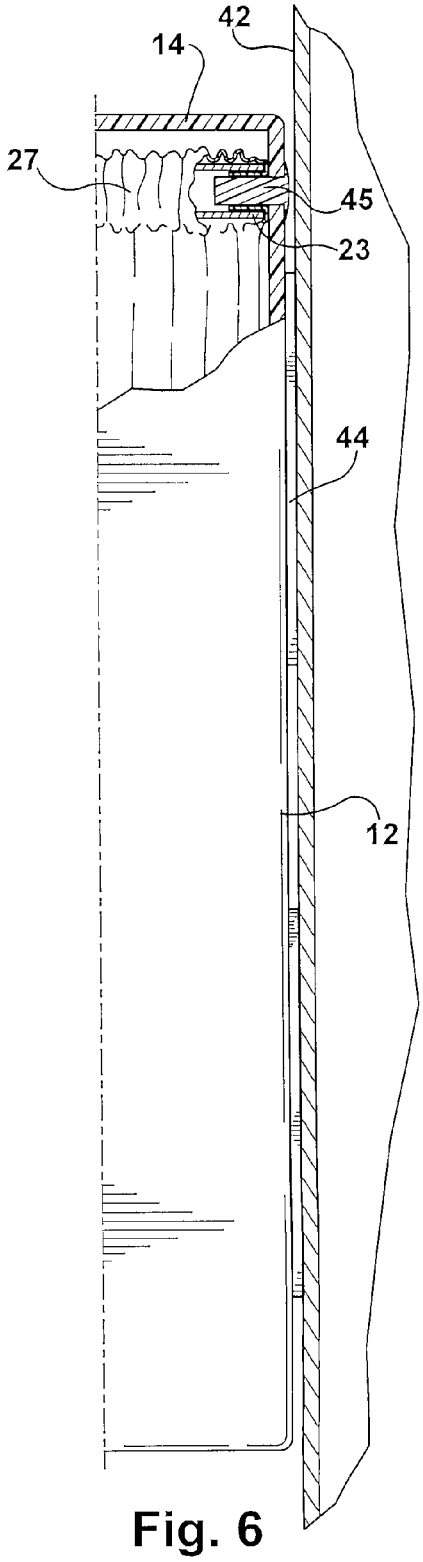
FIG. 6 is schematic view of the casing of the portable modesty guard mounted to a surface, according to another embodiment of the present invention.

With regard to FIG. 6, FIG. 6 illustrates portable modesty guard 10 attached or mounted to a surface 42 via at least one mounting member 44. In this embodiment, each mounting member 44 is independently selected from a magnetic strip, a pressure sensitive adhesive, double sided tape, mounting putty, etc. As can be seen in FIG. 6 with respect to top extendable support member 23, the internal end of top and bottom extendable support members 23 and 25 can be secured to casing 14 via an attachment device 45. Suitable attachment devices 45 include, but are not limited to, rivets, bolts, screws, nails, pins, clips, adhesive bonds, metal welds, ultrasonic welds, etc. In addition, the screen or shield 27 can be fixed into position by folding a portion of shield material into support members 23, 25 and anchoring the shield with an attachment device such that a portion of the shield 27 is lodged between the extendable support members 23, 25 and the attachment device.

Figure 7:
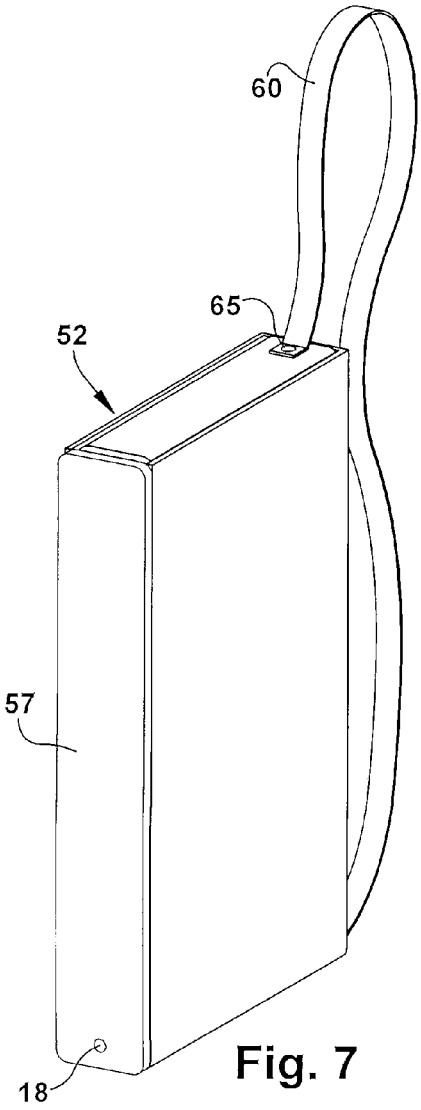
FIG. 7 is a perspective view of an alternative portable modesty guard in a closed position, according to another embodiment of the present invention.
Figure 8:
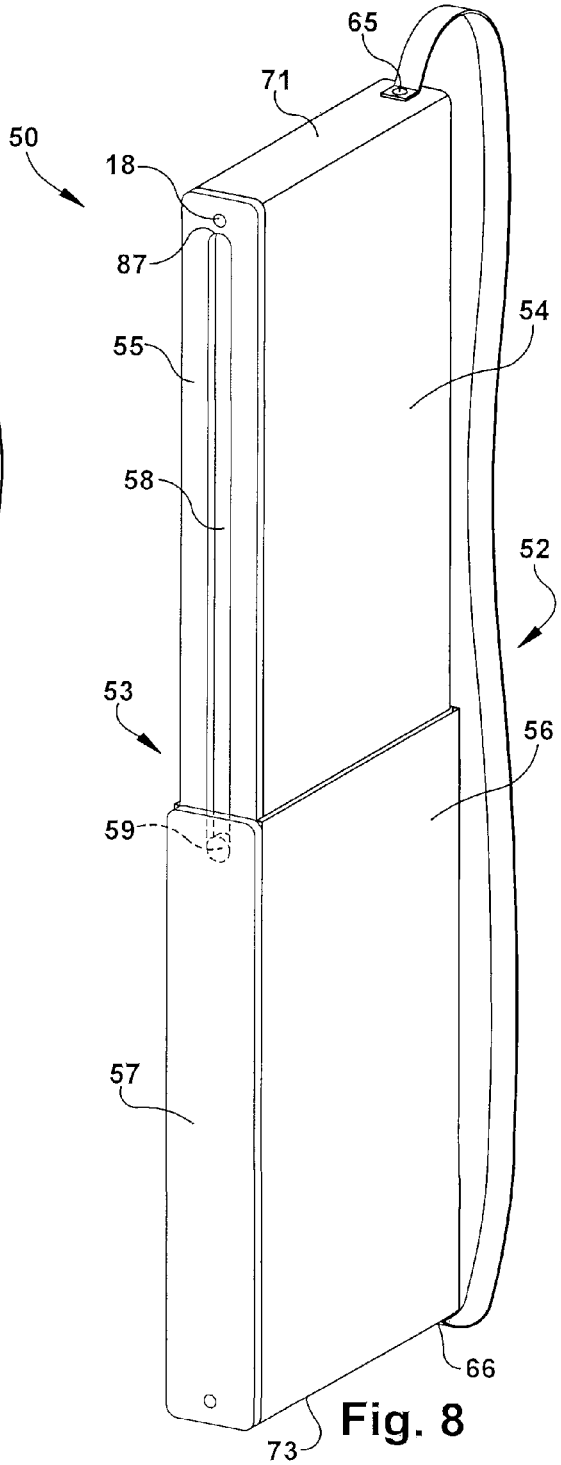
FIG. 8 is a perspective view of the portable modesty guard of FIG. 7 in an extended position, according to another embodiment of the present invention.

FIG. 7 is a perspective view of an alternative portable modesty guard 50, according to another embodiment of the present invention. Portable modesty guard 50 is shown in a closed position in FIG. 7 and has a casing 52 that is extendable and can be enlarged for greater privacy. FIG. 8 shows the casing in an extended position and has an inner casing portion 54 of casing 52 and outer casing portion 56 of casing 52. The inner casing portion 54 nests inside outer casing portion 56 and they can slide relative to one another such that the casing 52 can extend to provide additional privacy. Inner casing portion 54 of casing 52 and outer casing portion 56 of casing 52 have an inner end panel 55 and outer end panel 57, respectively. In another embodiment, inner end panel 55 includes a slot 58. Notch 59 (FIG. 15) extends inward from inner surface of outer end panel 55 and is sized to fit through slot 58 and hold inner end panel 55 in an extended position. For example, the end portion of slot 58 can be sized to compression fit around notch 59 so that inner end panel 55 remains in the extended position until an external force, for example a force greater than the force of gravity, is applied to the inner end panel to move it back into the nested position shown in FIG. 7. Alternatively, fastening mechanisms other than slot 58 and notch 59 can be used to retain inner casing portion 54 of casing 52 in an extended position. For example, fastening mechanisms can include. but are not limited to, latches, hooks, screws, bolts, etc.

In any of the embodiments described above, portable modesty guard 10, 50 can optionally include a carrying strap 60 that attaches to the casing 52. For example, carrying strap 60 is shown in FIGS. 7 and 8 attached to top 71 of inner casing portion 54 at one end and bottom 73 of outer portion 56 at a second end. Carrying strap 60 is attached to casing 52 via any suitable attachment device 65 and 66. Such suitable attachment devices include, but are not limited to, rivets, bolts, screws, nails, pins, clips, adhesive bonds, metal welds, ultrasonic welds, etc. Carrying strap 60 is shown attached along the heavier portion of casing 52 and opposite the inner end panel 55 and outer end panel 57, although carrying strap 60 can be attached anywhere on the casing or the end panels.

Figure 9:
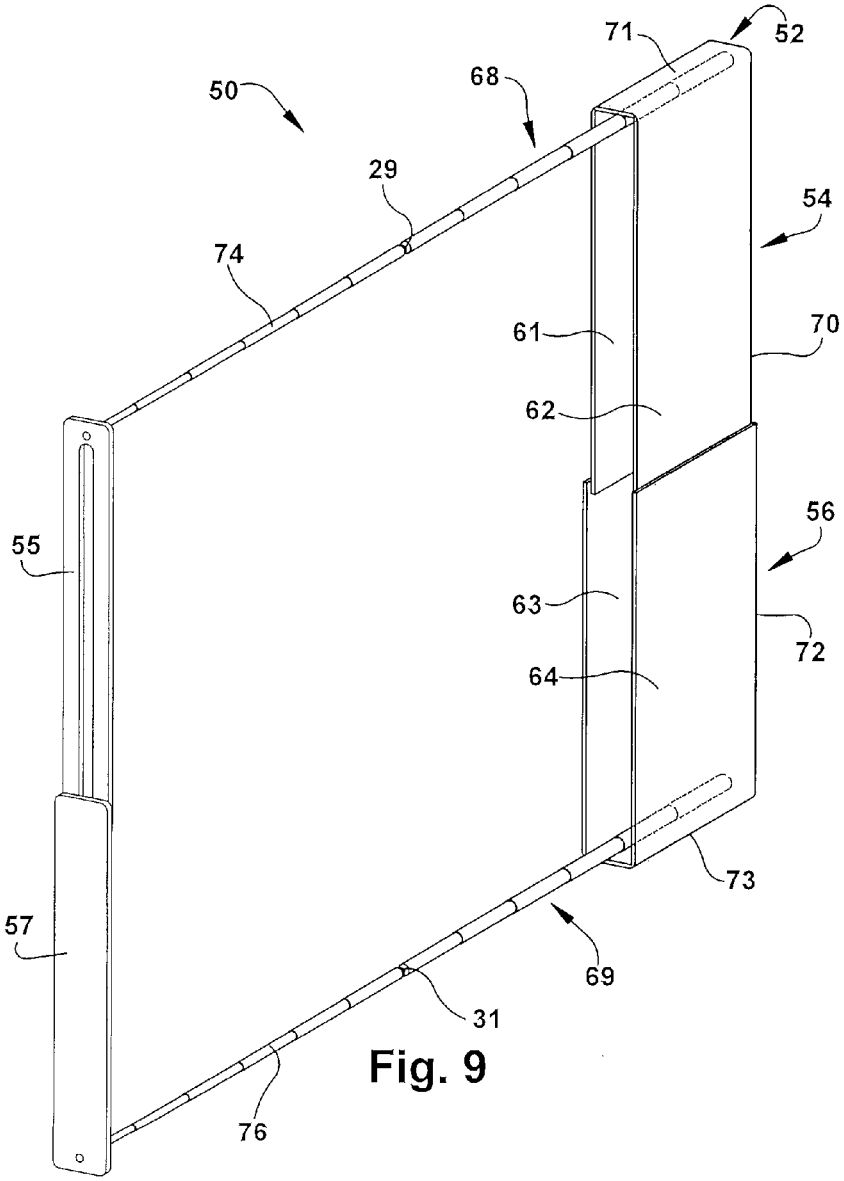
FIG. 9 is a perspective view of a portable modesty guard that is skeletal and without a shield, according to an embodiment of the present invention.

FIG. 9 is a perspective view showing of a portable modesty guard 50 in an open and extended position and open position and as a "skeletal" view without a shield. Portable modesty guard 50 comprises a top extendable support member 68 secured between inner casing portion 54 of casing 52 and inner end panel 55. A bottom extendable support member 69 is secured between outer casing portion 56 of casing 52 and outer end panel 57. Top extendable support member 68 and bottom extendable support member 69 are attached to end panels 70 and 72 of inner casing portion 54 and outer casing portion 56, respectively, in the same variety of methods and devices as described above with respect to top and bottom extendable support members 23 and 25 of FIG. 1 through FIG. 6, for example, attachment device 45. Such suitable attachment devices for the support members 68 and 69 include, but are not limited to, rivets, bolts, screws, nails, pins, clips, adhesive bonds, metal welds, ultrasonic welds, etc.

In any of the embodiments described above, the top and bottom extendable support members 68 and 69 can be formed from a plurality of telescoping units 74, 76 that slide inward or outward in overlapping sections. The plurality of telescoping units 74, 76 that form the top and bottom extendable support members 68, 69 can be any suitable shape. As shown, the telescoping units 74, 76 of FIG. 9 are round and telescoping units 28, 32 of FIG. 2 are square, although other suitable shapes include, but are not limited to, oval elliptical, rectangular, polygonal shapes, etc. Also, telescoping units of top extendable support members 23 and 68 may have a different shape than the telescoping units of bottom extendable support member 25 and 69. The top and bottom extendable support members 68 and 69 each can further include at least one bending or flexing unit or mechanism 77 and 78, for example a joint, hinge or other suitable type of flexing unit, to permit the portable modesty guard to extend in at least two different directions or planes.

In any of the embodiments of portable modesty guard 50, inner casing 54 and outer casing 56 may be reversed. For example, FIG. 9 shows top extendable support member 68 attached to inner casing 54 nests inside the bottom extendable support member 69 which is attached to outer casing 56, however, alternatively in any of the embodiments described herein, the bottom casing 56 can nest inside top casing 54. FIG. 9 shows that casing portion 54 has four sides, a first sidewall 61, a second sidewall 62 which is substantially parallel to sidewall 61, an inner casing base 70, and a top 71. Casing portion 56 also has four sides and includes first sidewall 63, second sidewall 64, outer casing base 72 and bottom 73.

Figure 10:
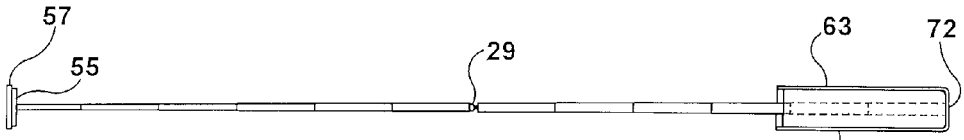
FIG. 10 is a top view of the portable modesty guard of FIG. 9, according to another embodiment of the present invention.

FIG. 10 is a top view of the portable modesty guard 50 of FIG. 9 shown extending in a single plane. The top view shows the inner end panel 55 and outer end panel 57 are adjacent to one another, and may be in contact or spaced apart.

Figure 11:
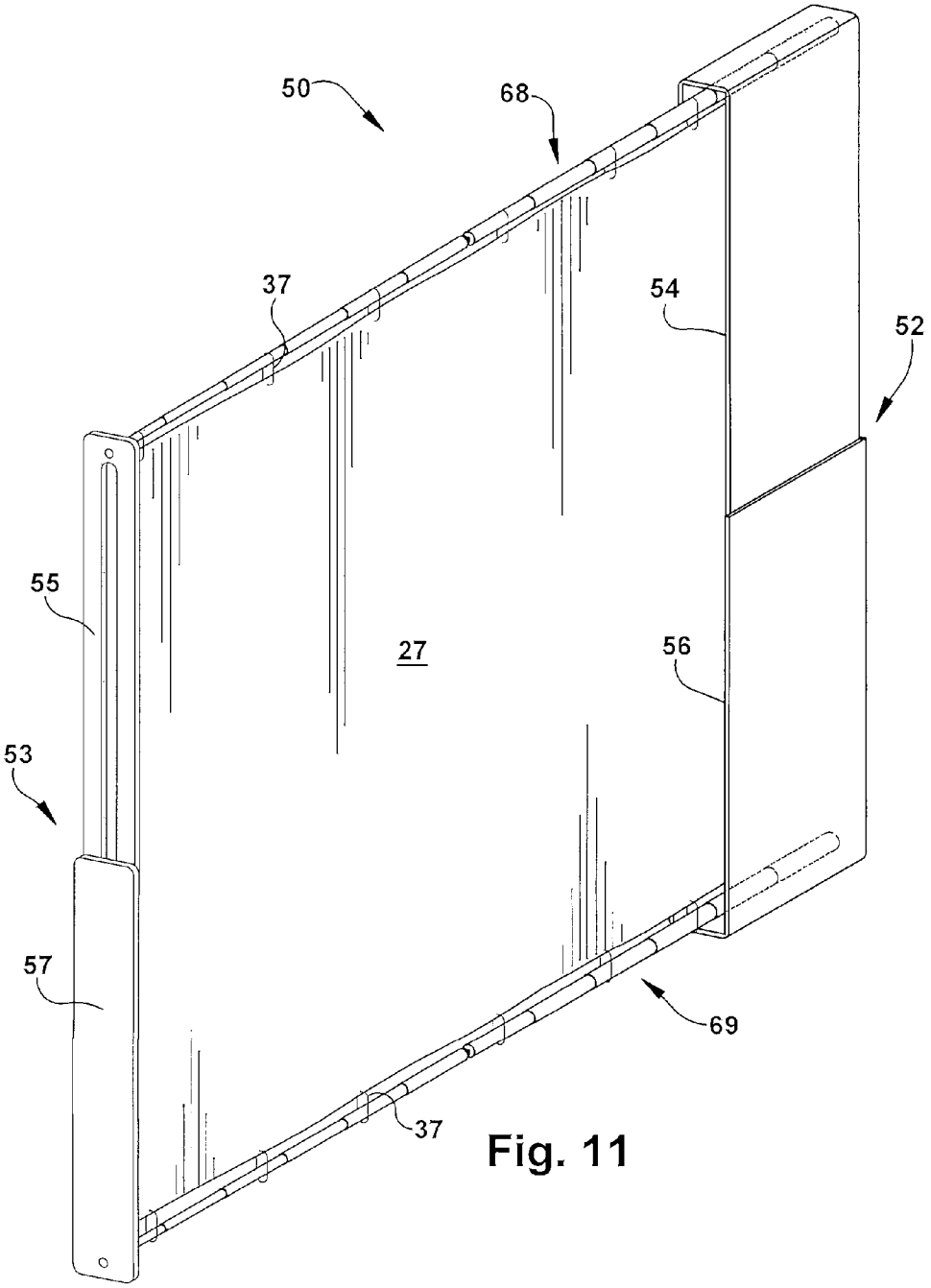
FIG. 11 is a perspective view of a portable modesty guard in an extended and open position, according to an embodiment of the present invention.
Figure 12:
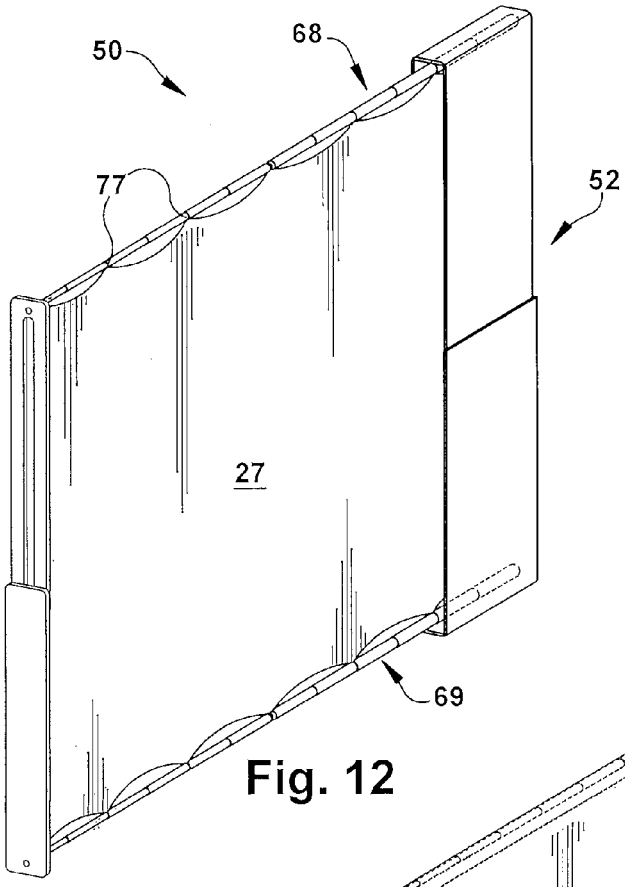
FIGS. 12 and 13 are perspective views of a portable modesty guard in an extended position, according to alternative embodiments of the present invention.
Figure 13:
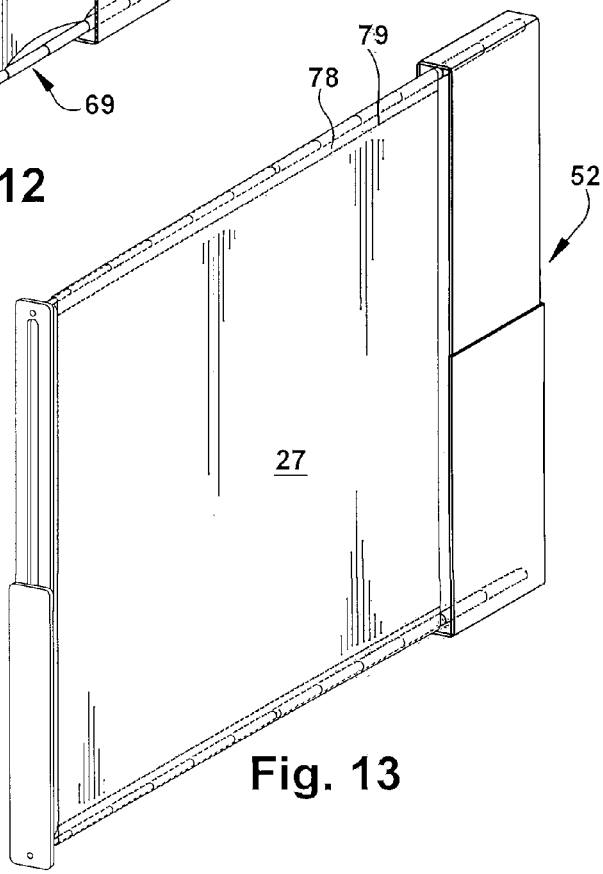

FIGS. 11, 12 and 13 is a perspective view of alternative embodiments of portable modesty guard 50 in an open position and further including various types of shields, as shown smooth or draping naturally, although the shield in any of the embodiments herein can be also be corrugated or have an alternative pre-formed or folded pattern. FIG. 11 shows shield 27 disposed between top and bottom extendable support members 68, 69 and attached by connection device 37. For example, connection device 37 is shown as a retention clip or hanger designed to either hang the screen or shield 27 from the top and bottom extendable support members 68, 69. The use of the clip or a hanger allows the shield 27 to move freely along the top and bottom extendable support members. FIG. 12 illustrates an example embodiment where the shield 27 is bound to the top and bottom extendable support members 68, 69. As illustrated, the shield can be bound to a fastener 77 or fit into a slot formed in the bottom surface of the top extendable support member 68 and at various telescoping units along the top and bottom extendable support members, including those inside casing 52. Thus, when portable modesty shield is opened and extended, the bound shield will not pull away from the casing and will hang substantially evenly along the support members 68, 69. FIG. 13 illustrates another embodiment in which screen or shield 27 is attached, secured or otherwise connected to top and bottom extendable support members 68, 69 by a connection device that is a loop 78 formed in the shield material of shield 27 or an alternative material. The material of the shield can include seams 79 that can be loose fitting or form a tighter loop to substantially bind the shield in place along the support members 68, 69.

Figure 14:
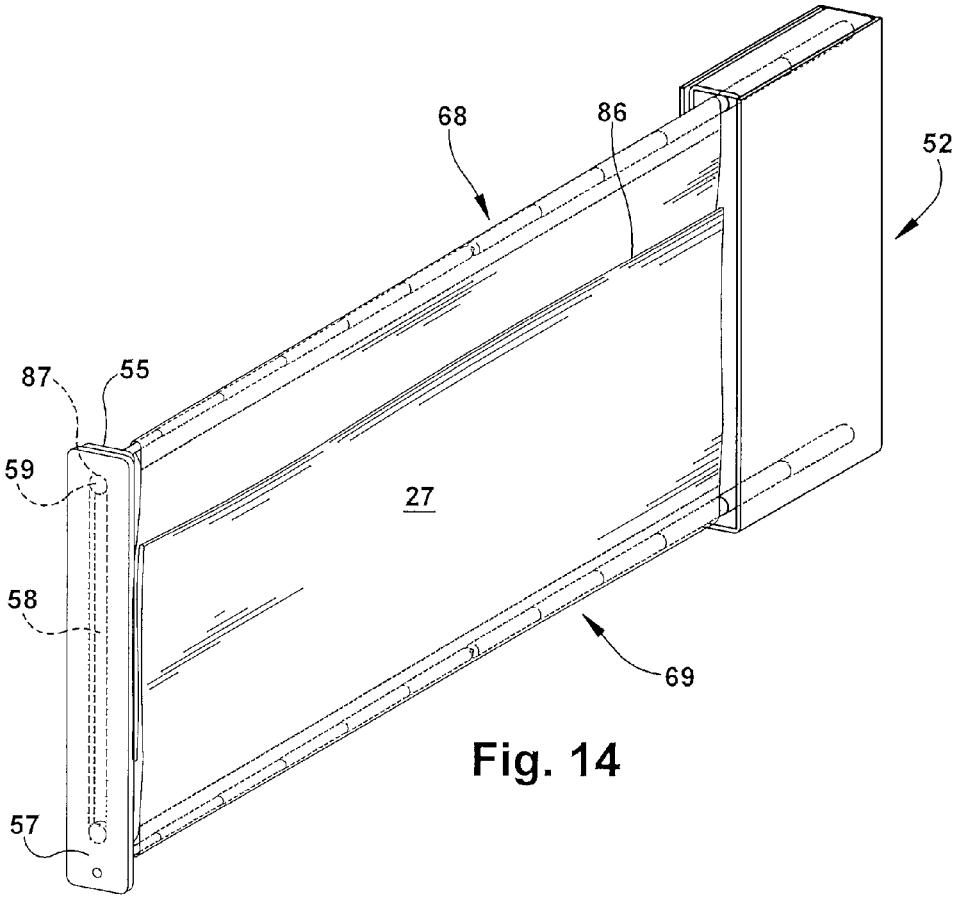
FIG. 14 is a perspective view of the portable modesty guard of FIG. 13 and shown in a nested position, according to an embodiment of the present invention.

FIG. 14 is a perspective view of the portable modesty guard 50 of FIG. 13 and shown in an open and nested position when the user can be in the process of opening the portable modesty guard for use or in the process of stowing it away. When casing 52 is nested, the shield 27 can fold, bunch or become oriented in a layered fashion. As described above, a myriad of types of material can be used for the shield, for example a lightweight nylon, and the shield 27 can slide easily over itself to create a fold 86. Notch 59 engages with top edge 87 of slot 58 which provides a positive stop for inner end panel 55 to remain in the nested position.

Figure 15:
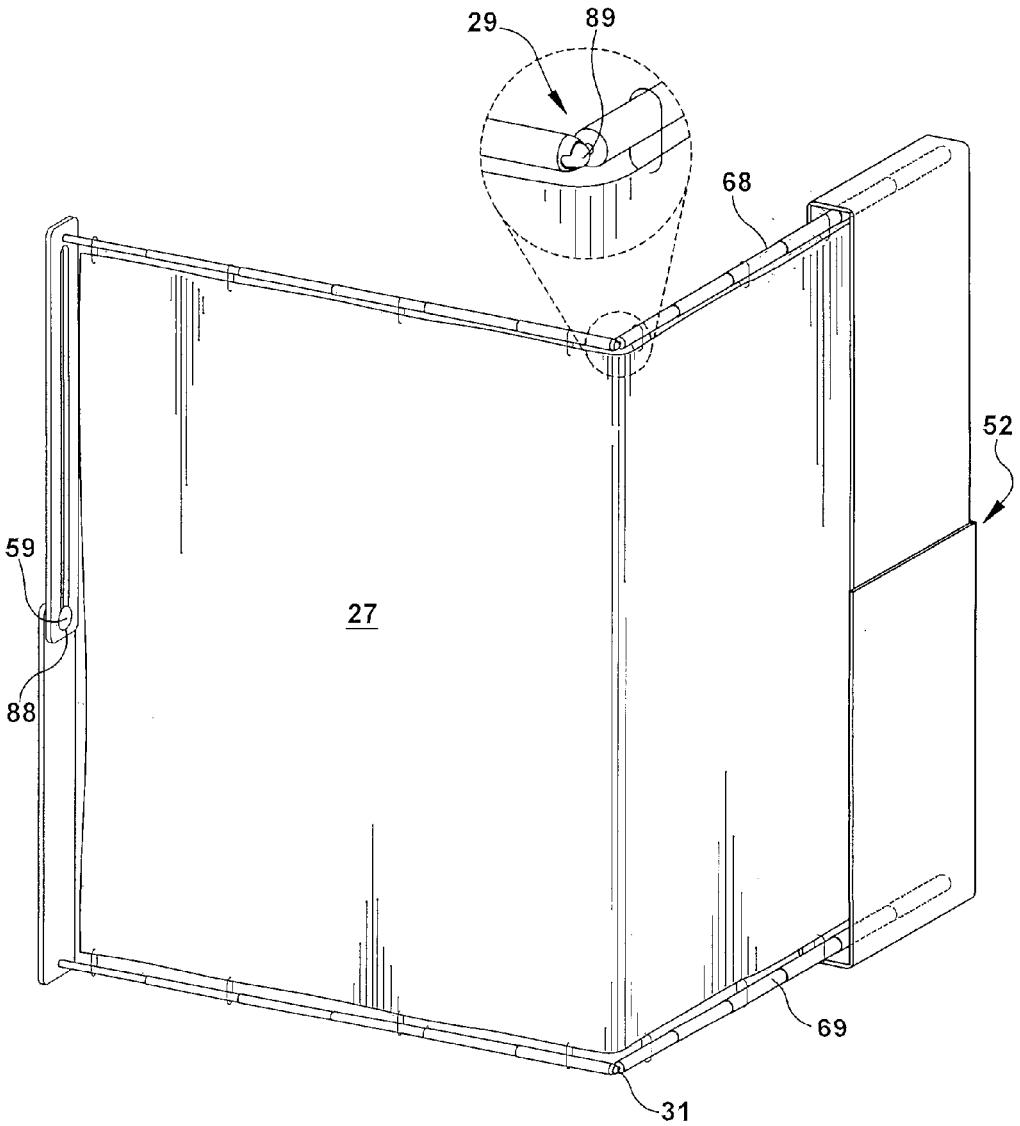
FIG. 15 is a perspective view of the portable modesty guard of FIG. 11 and shown in an open position and wherein the first extendable support member and second extendable support member are extended and disposed in two planes, according to an embodiment of the present invention.

FIG. 15 is a perspective view of the portable modesty guard 50 of FIG. 11 and shown in an open position and wherein the first extendable support member and second extendable support member are extended and disposed in two planes, according to an embodiment of the present invention. The top and bottom extendable support members 68 and 69 each can independently further comprise at least one bending or flexing unit or mechanism 29 and 31, respectively. The closer break-out view shows a flexing unit, for example a ball-type joint 89, between telescoping units 74, 76 and that permits the portable modesty guard to extend in at least two different planes. This allows the user to create additional privacy or to utilize the portable modesty guard in a confined space. In any of the embodiments described above, portable modesty guard 10, 50 can be attached or mounted to surface with one or more mounting members 44 as illustrated in FIG. 5.

Figures 16, 17, 18:
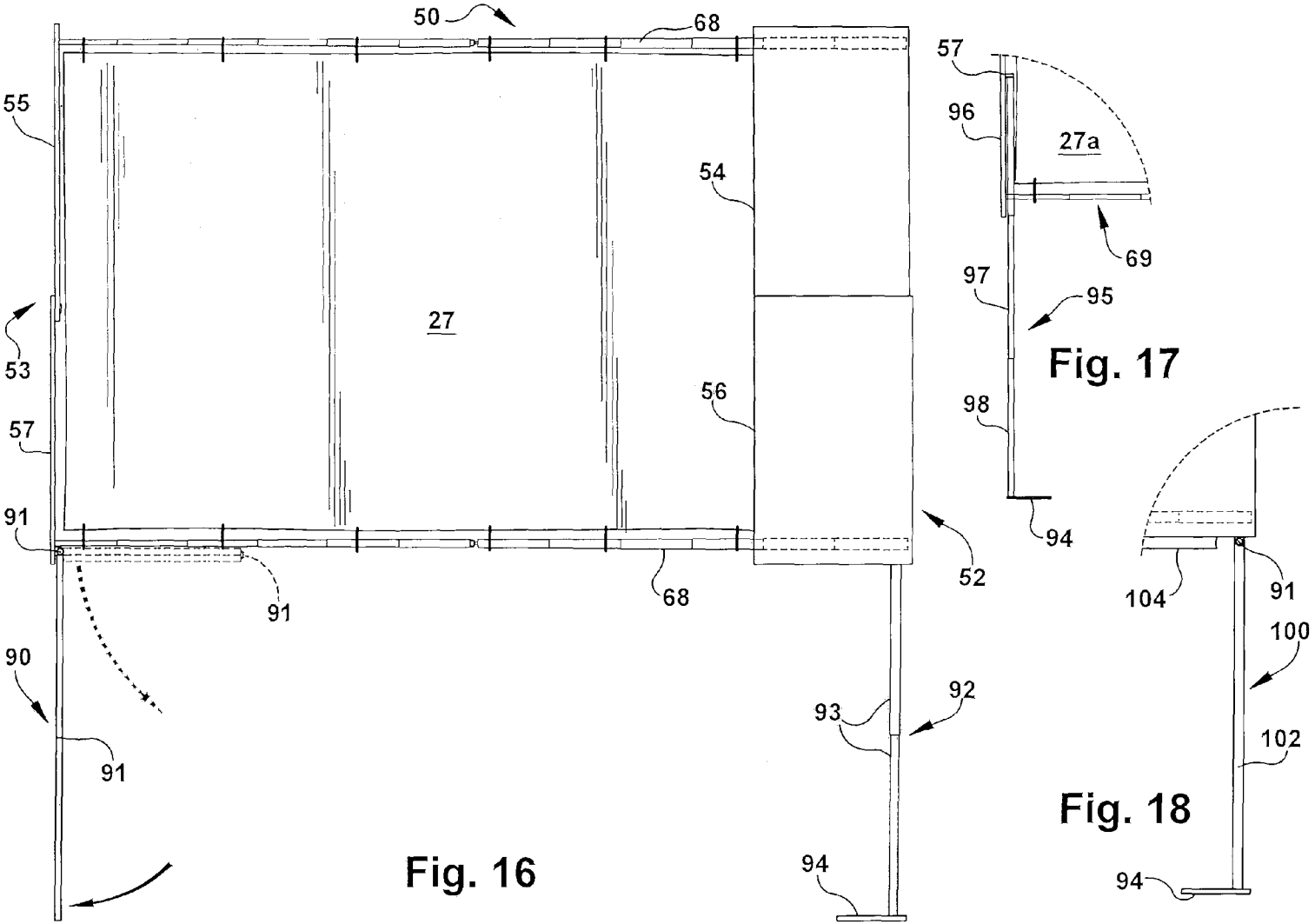
FIG. 16 is a front view of a portable modesty view comprising at least one brace according to another embodiment of the present invention.
FIG. 17 is a break-out view of the portable modesty guard of FIG. 16 showing an alternative brace, according to another embodiment of the present invention.
FIG. 18 is a break-out view of portable modesty guard of FIG. 17 showing an alternative brace, according to another embodiment of the present invention.

In any of the embodiments described herein, portable modesty guard 10, 50 may further include one or more braces for support to achieve a free-standing unit or to provide additional support when the portable modesty guard is affixed to another surface, for example a wall. FIG. 16 is a front view of portable modesty guard 50 comprising end panel brace 90 according to another embodiment of the present invention. End panel brace 90 is shown attached to the bottom extendable support member 69 or the outer end panel 57 or both. End panel brace 90 include a flexing members 91 such as a joint, hinge, or elastic cord, for example, that allows it to folds onto itself (shown in phantom) and also lie against bottom extendable support member 69 so that it may be tucked inside casing 52, for example outer casing portion 56, when the portable modesty guard 50 is closed. Casing brace 92 is shown as a telescoping brace and comprising telescoping units 93 that can slide into the outer casing portion 56 adjacent to the bottom extendable support member 69. Braces 90, 92 optionally include a foot or base, such as base 94 which is substantially orthogonal to brace 92, for additional stability. Casing brace 94 can flex and can be pushed inside casing 52 or positioned along the external surface of casing 52. Alternative embodiments include one or more of the braces described above and in any combination of brace construction described in the example embodiments/

FIG. 17 is a break-out view of a brace 95 according to an alternative embodiment. Brace 95 also includes telescoping units 96, 97 and 98 and units 97 and 98 can nest into telescoping unit 96 which resides inside casing 52 or between end panel 53, for example outer end panel 57, and shield 27. Once nested, foot or base 94 can lie parallel to bottom extendable support member 69 and is tucked into casing 52 when portable modesty unit is closed. FIG. 18 is a break-out view showing an alternative brace 100. In one embodiment brace 100 is a single unit 102 that is detachable from the casing, or alternatively, remains attached to portable modesty guard 50 and include a flexing member 91 so that it may be swung upward and parallel to casing 52 when not in use. Portable modesty unit may further include a cradle 104 that receives and retains brace 98 via an interference fit, e.g. a pressure fit, snap fit, etc.

In any of the embodiments of portable modesty guard 50 described above may include several of the same features described with respect to portable modesty guard 10 shown in FIGS. 1 through 6. For example, a closure device such as a latch which includes a lever 20 and catch 21 (FIGS. 1 and 2) can be used. Top and bottom extendable support members 68 and 69 can be secured to casing 14 via an attachment device 45 (FIG. 6). Suitable attachment devices 45 include, but are not limited to, rivets, bolts, screws, nails, pins, clips, adhesive bonds, metal welds, ultrasonic welds, etc. Also, portable modesty guard 50 can be mounted or affixed to a surface using a mounting member 44 (FIG. 6), including but not limited to, suction device 40, or a magnetic strip, a pressure sensitive adhesive, double sided tape, mounting putty, etc.

A method for using a portable modesty guard 10, 50 includes extending a first extendable support member 28, 68 and a second extendable support member 32, 69 outward from a casing 14, 52 and along an axis to expand the visible surface area of a shield 27. The method also includes supporting the portable modesty guard by mounting the casing to a surface, for example a wall surface, or bracing the portable modesty guard to a surface, for example a floor surface. In one example embodiment, the method includes separating the end panel from the casing to open the portable modesty guard, and expanding the visible surface area of the shield as the first and second extendable support members are extended.

While in accordance with the patent statutes the best mode and certain embodiments of the invention have been set forth, the scope of the invention is not limited thereto, but rather by the scope of the attached. Therefore, the invention, in its broader aspects, is not limited to the specific details, the representative apparatus, and illustrative examples shown and described. As such, other variants within the spirit and scope of this invention are possible and will present themselves to those skilled in the art.

What is claimed is:

1. A portable modesty guard comprising:

a casing comprising a base;

an end panel;

a first extendable support member, the first extendable support member being operatively coupled to the casing and the end panel;

a second extendable support member, the second extendable support member being operatively coupled to the casing and the end panel;

the first extendable support member is attached to the base and is extendable away from the base, and the second extendable support member is attached to the base and are extendable away from the base;

wherein the first extendable support member comprises a flexing unit disposed between a proximal end and a distal end of the first extendable support member which allows the first extendable support member to extend along two planes, and the second extendable support member comprises a flexing unit disposed between a proximal end and a distal end of the second extendable support member which allows the second extendable support member to extend along two planes;

a shield, the shield extending between the first and second extendable support members; and wherein the first extendable support member comprises a plurality of telescoping units, and the second extendable support member comprises a plurality of telescoping units.

2. The portable modesty guard of claim 1, wherein at least a portion of the first extendable support member and a portion of the second extendable support member are substantially parallel.

3. The portable modesty guard of claim 1, wherein the shield is made of material comprising polymer.

4. The portable modesty guard of claim 1, wherein the first extendable support member comprises a flexing unit and the second extendable support member comprises a flexing unit.

5. The portable modesty guard of claim 4, wherein the casing comprises a base and the proximal end of the first extendable support member and the proximal end of the second extendable support member are attached to the base, and the distal end of the first extendable support member and the distal end of the second extendable support member are attached to the end panel.

6. The portable modesty guard of claim 1, wherein shield is corrugated.

7. The portable modesty guard of claim 1, wherein the portable modesty guard comprises a plurality of connection devices to attach or secure the shield to the first extendable support member and the second extendable support member.

8. The portable modesty guard of claim 1, further comprising a handle.

9. The portable modesty guard of claim 1, further comprising a carrying strap.

10. The portable modesty guard of claim 1, further comprising a closure device.

11. The portable modesty guard of claim 1, wherein the end panel comprises a lever and the casing comprises a catch that receives the lever when the portable modesty guard is in a closed position.

12. The portable modesty guard of claim 1, wherein the casing further comprises a mounting element.

13. The portable modesty guard of claim 12, wherein the mounting element is disposed on an external surface of the base of the casing.

14. The portable modesty guard of claim 13, wherein the mounting element is at least one of a magnet and a suction device.

15. The portable modesty guard of claim 1, wherein the shield is made of a material selected from the group selected the group of: fabric, polymer, and fiber.

16. The portable modesty guard of claim 1, wherein the shield is made of fabric.

17. The portable modesty guard of claim 1, further comprising a brace for support.

18. A portable modesty guard comprising:

a casing;

an end panel;

a first extendable support member and a second extendable support member attached to the casing and to the end panel, wherein the first extendable support member and the second extendable support member are extendable away from the casing;

wherein the first extendable support member comprises a plurality of telescoping units and the second extendable support member comprises a plurality of telescoping units;

wherein the first extendable support member comprises a flexing unit and the second extendable support member comprises a flexing unit;

a shield that extends between the first extendable support member and the second extendable support member; and wherein the casing comprises an inner casing portion and an outer casing portion and are movable relative to one another between a nested position and an extended position.

19. The portable modesty guard of claim 18, wherein:

the inner casing portion comprises a first sidewall, a second sidewall and an inner casing base; and the outer casing portion comprises a first sidewall, a second sidewall and an outer casing base.

20. The portable modesty guard of claim 18, wherein the end panel comprises an inner end panel and an outer end panel, the inner end panel and outer end panel are movable relative to one another between a nested position and an extended position.

21. The portable modesty guard of claim 18, wherein the flexing unit of the first extendable support member is disposed between a proximal end and a distal end of the first extendable support member which allows the first extendable support member to extend along two planes, and the flexing unit of the second extendable support member is disposed between a proximal end and a distal end of the second extendable support member which allows the second extendable support member to extend along two planes.

22. A method for using a portable modesty guard comprising:

extending a first extendable support member comprising a plurality of telescoping units and a second extendable support member comprising a plurality of telescoping units outward from a casing and along an axis to expand the visible surface area of a shield;

positioning the first extendable support member such that the first extendable support member lies along two different planes, and positioning the second extendable support member such that the second extendable support member lies along two different planes;

wherein the first extendable support member comprises a flexing unit between a proximal end and a distal end of the first extendable support member, and the second extendable support member comprises a flexing unit between a proximal end and a distal end of a second extendable support member; and supporting the portable modesty guard by mounting the casing to a surface or bracing the portable modesty guard to a surface.

* * * * *